US011261880B2

(12) United States Patent
Merritt et al.

(10) Patent No.: US 11,261,880 B2
(45) Date of Patent: Mar. 1, 2022

(54) MOTOR AND BEARING COOLING PATHS

(71) Applicant: Hamilton Sundstrand Corporation, Charlotte, NC (US)

(72) Inventors: Brent J. Merritt, Southwick, MA (US); Craig M. Beers, Wethersfield, CT (US); John M. Beck, Windsor, CT (US)

(73) Assignee: Hamilton Sundstrand Corporation, Charlotte, NC (US)

( * ) Notice: Subject to any disclaimer, the term of this patent is extended or adjusted under 35 U.S.C. 154(b) by 62 days.

(21) Appl. No.: 16/530,511

(22) Filed: Aug. 2, 2019

(65) Prior Publication Data

US 2021/0033113 A1 Feb. 4, 2021

(51) Int. Cl.

*F04D 29/58* (2006.01)
*F04D 25/08* (2006.01)
*F04D 29/42* (2006.01)

(52) U.S. Cl.

CPC ..... *F04D 29/5806* (2013.01); *F04D 25/082* (2013.01); *F04D 29/4206* (2013.01); *F04D 29/584* (2013.01)

(58) Field of Classification Search

CPC .. F04D 29/284; F04D 29/4206; F04D 29/584; F04D 29/5806; F04D 29/051; F04D 29/0513; F04D 29/057; F04D 25/082; F04D 25/0606

See application file for complete search history.

(56) References Cited

U.S. PATENT DOCUMENTS 7,302,804 B2 12/2007 Murry et al.
7,394,175 B2 7/2008 McAuliffe et al.
7,732,953 B2 * 6/2010 Telakowski ..... H02K 9/12 310/59
8,863,548 B2 10/2014 Hipsky
2007/0018516 A1 * 1/2007 Pal ..... H02K 7/14 310/61
2012/0017617 A1 * 1/2012 Beers ..... F04D 29/584 62/118
2012/0107105 A1 5/2012 Korenblik
2012/0156013 A1 * 6/2012 Binek ..... B64D 13/06 415/177
2015/0308456 A1 * 10/2015 Thompson ..... H02K 9/00 417/244
2017/0175748 A1 6/2017 Pal et al.

FOREIGN PATENT DOCUMENTS

KR 20170128823 11/2017

OTHER PUBLICATIONS

The Extended European Search Report for European Patent Application No. 19216109.9 dated Jul. 17, 2020.

* cited by examiner

*Primary Examiner* — Kenneth J Hansen

(74) *Attorney, Agent, or Firm* — Carlson, Gaskey & Olds, P.C.

(57) ABSTRACT

A compressor includes a rotor driven by a shaft and configured to compress air and a motor for driving the shaft. At least one bearing facilitates rotation of the shaft. A motor cooling loop is configured to provide motor cooling air to the motor. A bearing cooling loop is configured to provide bearing cooling air to the at least one bearing. A bearing support is configured to support the least one bearing, the bearing support includes an opening. A duct is configured to communicate air from the opening to an inlet of the compressor. A method for cooling a compressor is also disclosed.

10 Claims, 2 Drawing Sheets

MOTOR AND BEARING COOLING PATHS

BACKGROUND

This application relates to a compressor for an air machine.

Air machines include a turbine and a compressor. Partially compressed air is delivered to the compressor, and the compressor is driven to further compress this air. A motor drives the compressor. This compressed air is passed downstream to drive a turbine, with the turbine in turn helping to drive the compressor as the air expands across the turbine. This expanded air is then utilized for a downstream use, such as cabin air for an aircraft.

Air machines have a shaft which connects the compressor and the turbine. Bearings facilitate rotation of the shaft. Heat accumulates in the compressor as the air machine operates, and in particular, at the bearings and motor.

SUMMARY

A compressor according to an exemplary embodiment of this disclosure, among other possible things includes a rotor driven by a shaft and configured to compress air and a motor for driving the shaft. At least one bearing facilitates rotation of the shaft. A motor cooling loop is configured to provide motor cooling air to the motor. A bearing cooling loop is configured to provide bearing cooling air to the at least one bearing. A bearing support is configured to support the least one bearing, and the bearing support includes an opening. A duct is configured to communicate air from the opening to an inlet of the compressor.

In a further example of the foregoing, at least one bearing includes a first journal bearing upstream from the motor and a second journal bearing downstream from the motor.

In a further example of any of the foregoing, the bearing support supports at least the second journal bearing.

In a further example of any of the foregoing, a tie rod connects the shaft to a motor rotor shaft. The tie rod includes an opening which is configured to communicate air from the bearing cooling loop towards the rotor.

In a further example of any of the foregoing, the rotor includes an opening which is configured to communicate the air from the bearing cooling loop towards a compressor inlet.

In a further example of any of the foregoing, the opening is at an upstream end of the rotor.

In a further example of any of the foregoing, the bearing cooling loop includes a transfer tube. The transfer tube is configured to provide bearing cooling air to the second journal bearing from a bearing cooling air inlet.

In a further example of any of the foregoing, the duct communicates the air to the compressor inlet via an add-heat housing.

In a further example of any of the foregoing, the motor cooling loop includes a passage between the motor and the shaft. The bearing cooling loop includes the passage.

In a further example of any of the foregoing, a heat shield is located downstream from the bearing support and upstream from the motor.

In a further example of any of the foregoing, a first seal upstream from the bearing support, a second seal upstream from the first journal bearing, and a third seal upstream from the second journal bearing.

In a further example of any of the foregoing, the air includes air leaked from at least one of the first, second, and third seals.

A method for cooling a compressor according to an exemplary embodiment of this disclosure, among other possible things includes providing a first cooling air stream to at least one bearing. At least one bearing facilitates rotation of a shaft in a compressor. At least one seal is configured to limit the flow of the first cooling air stream. A second cooling air stream is provided to a motor. The motor is configured to rotate the shaft, and communicate air leaked from the at least one seal to an add-heat housing of the compressor.

In a further example of the foregoing, the method for cooling a compressor includes communicating the air leaked from the at least one seal through a passage in a bearing support. The bearing support is configured to support the at least one bearing.

In a further example of any of the foregoing, the communicating is via a duct external to the compressor.

In a further example of any of the foregoing, the method for cooling a compressor includes providing the first cooling air stream to the motor.

In a further example of any of the foregoing, at least one bearing includes a first journal bearing upstream from the motor and a second journal bearing downstream from the motor, and providing the first cooling air stream to the first journal bearing via a transfer tube.

DETAILED DESCRIPTION

Figure 1:
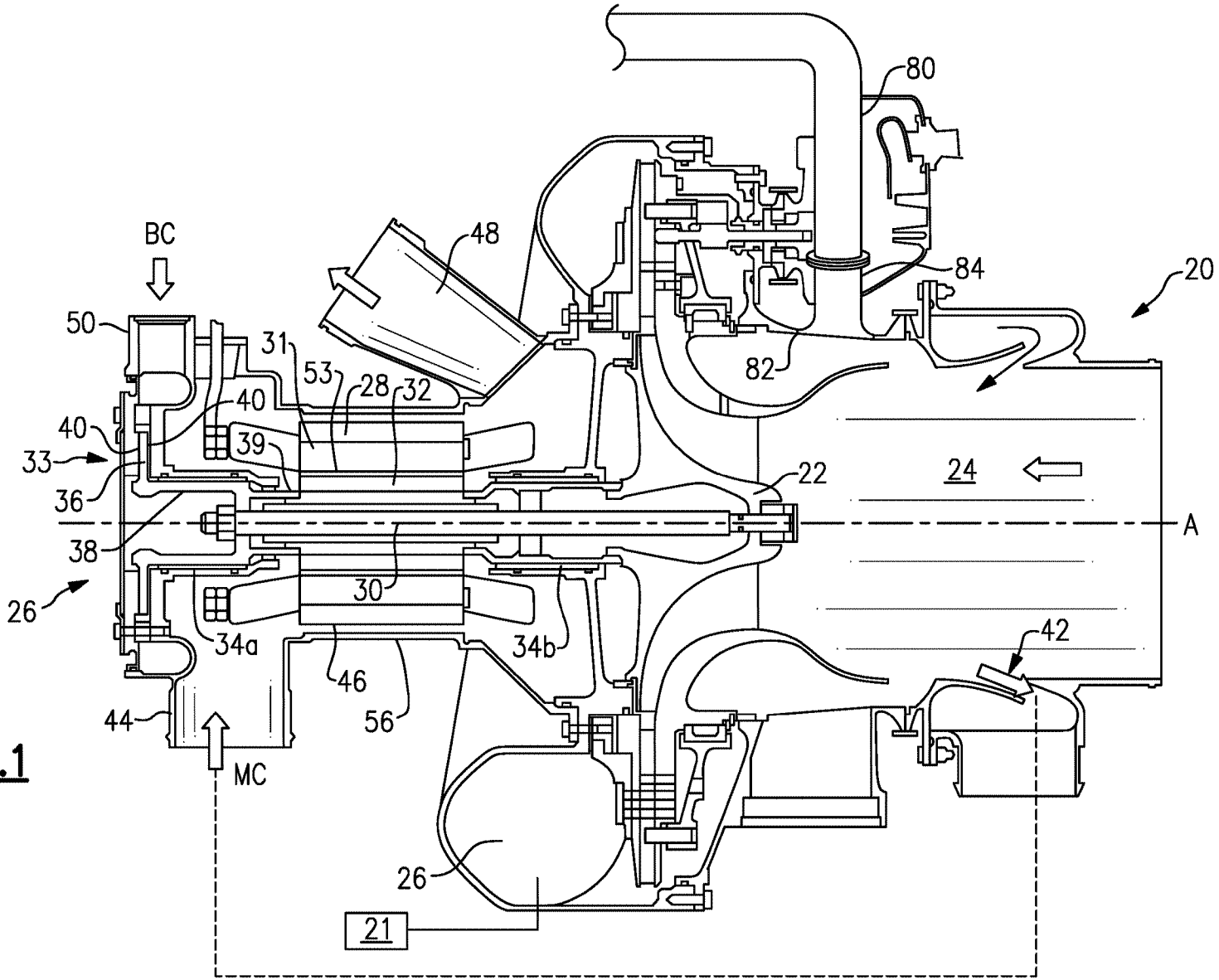
FIG. 1 shows a schematic cross-section of a compressor for an air machine.

FIG. 1 shows a compressor 20 that may be incorporated into a cabin air supply system 21 for supplying air to the cabin of an aircraft. A rotor 22 receives air to be compressed from an inlet 24, and compresses the air to a compressor outlet 26. A motor 28 drives a motor rotor shaft 39 and driveshaft 30 and to rotate the rotor 22. The motor 28 is an electric motor and includes a rotor 31 and a stator 32, as would be known in the art. In FIG. 1, air flows through the compressor from right to left.

A thrust bearing 33 and a journal bearings 34*a*, 34*b* facilitate rotation of the driveshaft 30. The thrust bearing 33 includes a thrust bearing disk 36 which is associated with a thrust shaft 38. The thrust shaft 38 connects to the motor rotor shaft 39. The thrust bearing disk 36 has thrust bearing surfaces 40.

Figure 2:
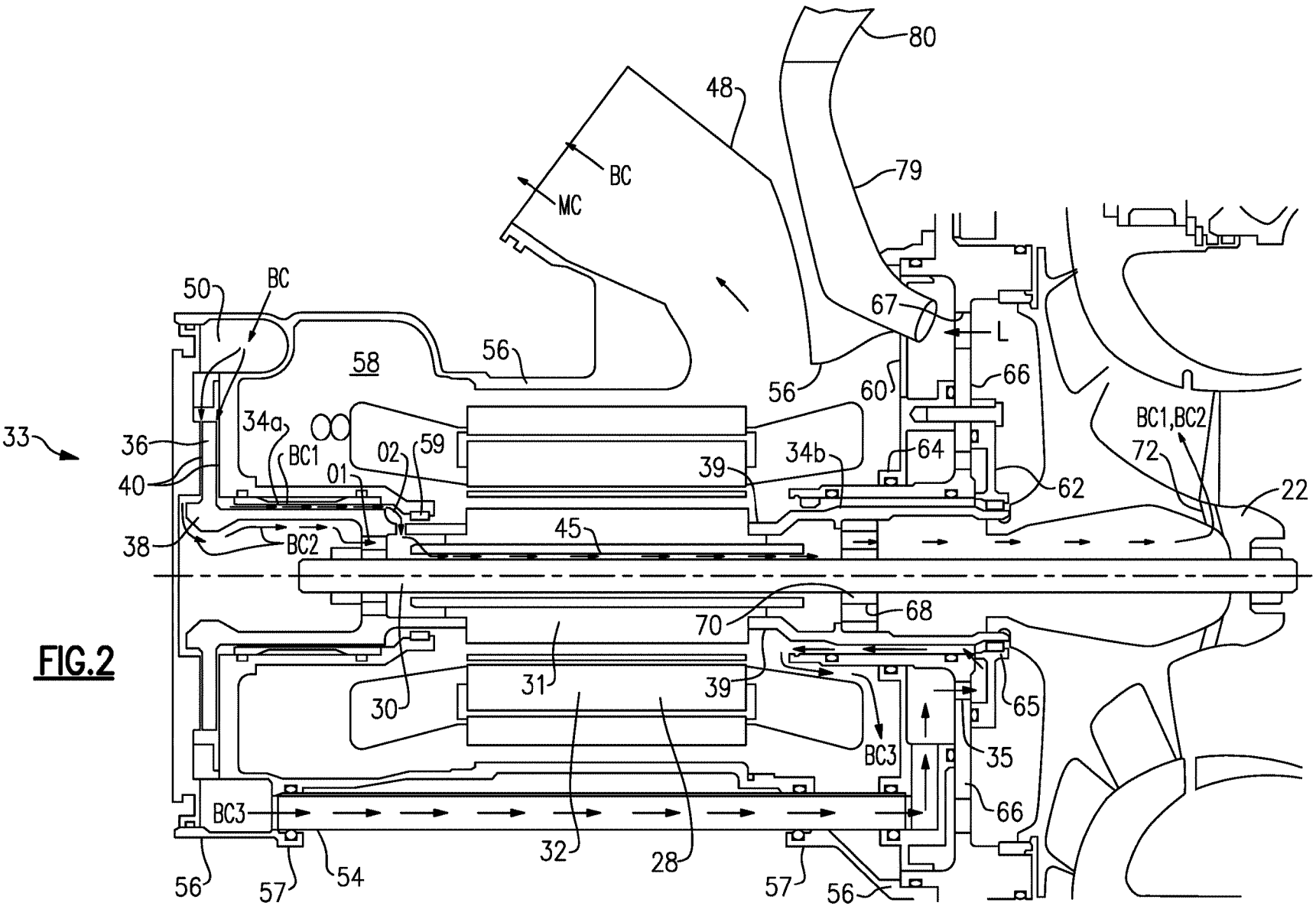
FIG. 2 shows a detail view the cross-section of FIG. 1.

The motor 28, the thrust bearing 33, and the journal bearings 34*a*, 34*b* are cooled with cooling air. FIG. 2 schematically shows a detail view of the motor 28 and bearing 33, 34*a*, 34*b*.

A motor cooling stream MC is drawn from the compressor inlet 20 at 42 and provided to a motor cooling inlet 44. The motor cooling stream MC ultimately exits the compressor 20 via a cooing air outlet 48. In one example, the outlet 48 ducts to ram (e.g., ambient) air. A bearing cooling stream BC is drawn from downstream of the compressor outlet 26 and provided to a bearing cooling inlet 50. In one example, a heat exchanger (not shown) is upstream from the bearing cooling inlet 50 and downstream from the compressor outlet 26, and cools air in the bearing cooling stream BC.

The bearing cooling stream BC cools the thrust bearing 33 and the journal bearings 34*a*, 34*b*, and provides cooling to the motor 28, will be explained in more detail below.

The bearing cooling stream BC is split into two bearing cooling streams BC1 and BC2, which pass along both sides of the thrust plate 36 at thrust surfaces 40 to cool the thrust bearing 33. The bearing cooling streams BC1 and BC2 continue along either side of the thrust shaft 38.

Orifices O1 and O2 are formed in the thrust shaft 38. The orifice O1 is oriented generally parallel to an axis A of the shaft 30 while the orifice O2 is oriented generally perpendicular to an axis A of the shaft 30. That is, the orifices O1, O2 are oriented generally perpendicular to one another. The first bearing cooling stream B1 passes through the journal bearing 34*a* and then through the orifice O2. The second bearing cooling stream BC2 passes through the orifice O1. The first bearing cooling stream BC1 then joins the second bearing cooling stream BC2 and both streams pass along the inside diameter of the motor 28, via a passage 45 adjacent the shaft 30, providing cooling to the motor 28 and/or shaft 30. The bearing cooling streams BC1, BC2 mix with at least a portion of the motor cooling stream MC, and then pass through an opening 68 in a tie rod 70, which is adjacent the journal bearing 34*b*. The tie rod 70 connects the motor rotor shaft 39 to the shaft 30. The bearing cooling streams BC1, BC2 and air from the motor cooling stream MC then pass through an opening 72 at the downstream end of the compressor rotor 22, adjacent the compressor inlet 24.

A third bearing cooling stream BC3 is also provided from the bearing cooling air inlet 50 to a transfer tube 54. The transfer tube 54 communicates the bearing cooling stream BC3 to the journal bearing 34*b*. The transfer tube 54 is attached to a housing 56 of the motor 28 via bosses 57.

Bearing cooling stream BC3 is provided to the journal bearing 34*b* via an opening 35 in a bearing support 66 (discussed more below) and passes through the journal bearing 34*b* in the same direction as the direction of airflow through the compressor 20. The third bearing cooling stream BC3 does not pass through the thrust bearing 33 or journal bearing 34*a*. Accordingly, the third bearing cooling stream BC3 is relatively cool compared to the first and second bearing cooling streams BC1, BC2 at the orifice O3. Therefore, the third bearing cooling stream BC3 provides improved cooling to the journal bearing 34*a* as compared to a cooling stream that has passed through the thrust bearing 33 and/or journal bearing 34*a*. The third bearing cooling stream BC3 ultimately exits the compressor 20 via cooling air outlet 48.

A seal 59, such as a labyrinth seal (though other types of seals are contemplated), is arranged immediately upstream from the journal bearing 34*a* and downstream from the motor 28. The seal 59 prevents the first bearing cooling stream BC1 from entering a cavity 58 between the thrust bearing 33 and the motor 28. Thus, the first bearing cooling stream BC1 is directed into the orifice O2 and then into the motor 28 (as discussed above) by the seal 59. Air in the cavity 58 thus stays cool relative to the temperature of air in the first bearing cooling stream BC1, and provides thermal insulation for the motor 28 and other compressor 20 components from the relatively hot first bearing cooling stream BC1. Additionally, the seal 59 prevents loss of pressure in the first bearing cooling stream BC1 as it travels through journal bearing 34*a*. In other words, the pressure drop of the first bearing cooling stream BC1 across the journal bearing 34*a* is relatively low. This improves the lifetime and reliability of the journal bearing 34*a*.

A heat shield 60 and seal plate 62 are provided upstream from the motor 28 and adjacent the journal bearing 34*b*. The seal plate 62 includes a seal 64 such as a vespel seal, though other types of seals are contemplated. The seal plate 62 includes a seal 64 such as a vespel seal or o-seal, though other types of seals are contemplated. In one example, seal 64 is a static o-seal. Seal 64 prevents high-pressure air in the third bearing cooling stream BC3 from leaking into the outlet 48 prior to entering the journal bearing 34*b*. In other words, the seal 64 helps direct bearing cooling stream BC3 into the journal bearing 34*b*. The seal plate 62 also includes a seal 65 such as a labyrinth seal (though other types of seals are contemplated) immediately downstream from the journal bearing 34*b*. As with the seal 59 adjacent the journal bearing 34*a*, the seals 64, 65 adjacent the journal bearing 34*b* maintain pressure in the journal bearing 34*b* to minimize pressure drop across the journal bearing 34*b*, which improves the lifetime and reliability of the journal bearing 34*b*.

The heat shield 60 and seal 64 are downstream from a bearing support 66, while the seal plate 62 and seal 65 are upstream of the bearing support 66. In this example, the bearing support 66 supports the journal bearing 34*b*. In some examples, the bearing support 66 includes an opening 67 through which leaked hot, high pressure air L within the compressor 20 can flow towards the outlet 48. The heat shield 60 thermally insulates the motor 28 (and in particular, the motor stator 31) and journal bearing 34*b* from the hot air. In one example, the leaked air L contains or includes leakage from any of the seals 59, 64, 65 or a combination thereof.

A leaked air outlet 79 extends through the motor housing 56. In this example, the leaked air outlet 79 is upstream from the cooling air outlet 48 and communicates the leaked air L from the opening 67 in the bearing support 66 to the duct 80. The duct 80 fluidly connects leaked air outlet 79 with an add-heat housing 82 adjacent the compressor inlet 24 via a connector 84 (FIG. 1). The duct 80 is external to the compressor 20. Accordingly, the leaked air L can serve as an auxiliary source of hot air in add-heat conditions. Ultimately, more air is available at the compressor inlet 24, and thus more air is available for being drawn as motor cooling air MC.

In one example, the motor housing 56 includes bosses or fittings for connecting to the duct 80. Likewise, the add-heat housing 82 and/or the connector 84 include bosses or fittings for connecting to the duct 80.

Although an embodiment of this invention has been disclosed, a worker of ordinary skill in this art would recognize that certain modifications would come within the scope of this invention. For that reason, the following claims should be studied to determine the true scope and content of this invention.

What is claimed is:

1. A compressor comprising:

a rotor driven by a shaft and configured to compress air;

a motor for driving the shaft;

at least one bearing for facilitating rotation of the shaft;

a motor cooling loop configured to provide motor cooling air to the motor;

a bearing cooling loop configured to provide bearing cooling air to the at least one bearing;

a bearing support configured to support the least one bearing, the bearing support including a first opening;

a duct configured to communicate air from the first opening to an inlet of the compressor; and a tie rod connecting the shaft to a motor rotor shaft, wherein the tie rod includes a second opening configured to communicate the bearing cooling air from the bearing cooling loop towards the rotor, and wherein the rotor includes a third opening configured to communicate the bearing cooling air from the bearing cooling loop to a compressor inlet.

2. The compressor of claim 1, wherein the third opening is at an aft end of the rotor.

3. The compressor of claim 1, wherein the at least one bearing includes a first journal bearing forward from the motor and a second journal bearing aft from the motor.

4. The compressor of claim 3, wherein the bearing support supports the second journal bearing.

5. The compressor of claim 1, wherein the bearing cooling loop includes a transfer tube, the transfer tube configured to provide the bearing cooling air to the second journal bearing from a bearing cooling air inlet.

6. The compressor of claim 3, further comprising a first seal aft from the bearing support, a second seal aft from the first journal bearing, and a third seal aft from the second journal bearing with respect to a central axis of the compressor.

7. The compressor of claim 6, wherein the bearing cooling air includes air leaked from at least one of the first, second, and third seals.

8. The compressor of claim 1, wherein the duct communicates the air from the first opening to the compressor inlet via an add-heat housing.

9. The compressor of claim 1, wherein the motor cooling loop includes a passage between the motor and the shaft, and wherein the bearing cooling loop includes the passage.

10. The compressor of claim 1, further comprising a heat shield forward from the bearing support and aft from the motor with respect to a central axis of the compressor.

* * * * *